US008084177B2

(12) United States Patent
Zhou et al.

(10) Patent No.: US 8,084,177 B2
(45) **Date of Patent: *Dec. 27, 2011**

(54) TONERS CONTAINING POLYHEDRAL OLIGOMERIC SILSESQUIOXANES

(75) Inventors: Ke Zhou, Oakville (CA); Karen A. Moffat, Brantford (CA); Maria N V. McDougall, Oakville (CA); Richard P N. Veregin, Mississauga (CA); Edward G. Zwartz, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 458 days.

This patent is subject to a terminal disclaimer.

(21) Appl. No.: 12/337,682

(22) Filed: Dec. 18, 2008

(65) Prior Publication Data

US 2010/0159375 A1 Jun. 24, 2010

(51) Int. Cl.
*G03G 9/00* (2006.01)
*G03G 5/00* (2006.01)

(52) U.S. Cl. ..... 430/108.3; 430/109.3; 430/109.4; 430/137.14

(58) Field of Classification Search ..... 430/108.3, 430/109.3, 109.4, 137.14
See application file for complete search history.

(56) References Cited

U.S. PATENT DOCUMENTS

| | | | |
|---|---|---|---|
| 2,297,691 | A | 10/1942 | Carlson |
| 2,618,552 | A | 11/1952 | Wise |
| 2,874,063 | A | 2/1959 | Greig |
| 2,919,171 | A | 12/1959 | Epstein et al. |
| 3,564,556 | A | 2/1971 | Tsukatani et al. |
| 3,611,419 | A | 10/1971 | Blumenthal |
| 4,155,093 | A | 5/1979 | Fotland et al. |
| 4,160,257 | A | 7/1979 | Carrish |
| 4,240,084 | A | 12/1980 | Tacklind et al. |
| 4,254,424 | A | 3/1981 | Landheer et al. |
| 4,267,556 | A | 5/1981 | Fotland et al. |
| 4,365,549 | A | 12/1982 | Fotland et al. |
| 4,408,214 | A | 10/1983 | Fotland et al. |
| 4,409,604 | A | 10/1983 | Fotland |
| 4,463,363 | A | 7/1984 | Gundlach et al. |
| 4,524,371 | A | 6/1985 | Sheridon et al. |
| 4,538,163 | A | 8/1985 | Sheridon |
| 4,569,584 | A | 2/1986 | St. John et al. |
| 4,619,515 | A | 10/1986 | Maczuszenko et al. |
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,943 | A | 12/1998 | Cheng et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,977,210 | A | 11/1999 | Patel et al. |
| 5,994,020 | A | 11/1999 | Patel et al. |
| 6,120,967 | A | 9/2000 | Hopper et al. |
| 2008/0090163 | A1 | 4/2008 | Agur et al. |
| 2008/0107989 | A1 | 5/2008 | Sacripante et al. |
| 2008/0153027 | A1 | 6/2008 | Veregin et al. |

OTHER PUBLICATIONS

Copending Application U.S. Appl. No. 12/337,688; filed Dec. 18, 2008, entitled "Toners Containing Polyhedral Oligomeric Silsesquioxanes," with the named inventors Ke Zhou, Maria N. V. McDougall, Yu Qi, Jordan H. Wosnick, Karen A. Moffat, Paul J. Gerroir, and Richard P. N. Veregin.

*Primary Examiner* — Thorl Chea
(74) *Attorney, Agent, or Firm* — Judith L. Byorick

(57) ABSTRACT

Disclosed is a toner composition comprising toner particles which comprise a resin, an optional colorant, and a polyhedral oligomeric silsesquioxane compound.

27 Claims, No Drawings

TONERS CONTAINING POLYHEDRAL OLIGOMERIC SILSESQUIOXANES

CROSS-REFERENCE TO RELATED APPLICATIONS

Application U.S. Ser. No. 12/337,688, now U.S. Patent Publication 20100159376 and U.S. Pat. No. 7,985,523, filed concurrently herewith, entitled "Toners Containing Polyhedral Oligomeric Silsesquioxanes," with the named inventors Ke Zhou, Maria N. V. McDougall, Yu Qi, Jordan H. Wosnick, Karen A. Moffat, Paul J. Gerroir, and Richard P. N. Veregin, discloses a toner composition comprising toner particles which comprise (a) a resin having chemically bonded thereto a polyhedral oligomeric silsesquioxane, (b) and an optional colorant.

BACKGROUND

Disclosed herein are toner compositions suitable for the development of latent electrostatic images. More specifically, disclosed herein are toner compositions containing polyhedral oligomeric silsesquioxanes therein. One embodiment is directed to a toner composition comprising toner particles which comprise a resin, an optional colorant, and a polyhedral oligomeric silsesquioxane. Another embodiment is directed to a process for preparing toner particles which comprises (a) contacting at least one resin and at least one POSS compound in an emulsion; (b) contacting the emulsion with an optional colorant dispersion, an optional wax, and an optional coagulant to form a mixture; (c) aggregating small particles in the mixture to form a plurality of larger aggregates; and (d) coalescing the larger aggregates to form toner particles. Yet another embodiment is directed to a process for preparing toner particles which comprises (a) contacting at least one resin in an emulsion; (b) contacting the emulsion with an optional colorant dispersion, an optional wax, and an optional coagulant to form a mixture; (c) aggregating small particles in the mixture to form a plurality of larger aggregates; (d) forming a second emulsion by contacting at least one shell resin and at least one POSS compound in the emulsion; (e) contacting the larger aggregates with the second emulsion to form a shell over the larger aggregates; and (f) coalescing the larger aggregates to form toner particles.

The formation and development of images on the surface of photoconductive materials by electrostatic means is well known. The basic electrophotographic imaging process, as taught by C. F. Carlson in U.S. Pat. No. 2,297,691, entails placing a uniform electrostatic charge on a photoconductive insulating layer known as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. Toner typically comprises a resin and a colorant. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Another known process for forming electrostatic images is ionography. In ionographic imaging processes, a latent image is formed on a dielectric image receptor or electroreceptor by ion or electron deposition, as described, for example, in U.S. Pat. No. 3,564,556, U.S. Pat. No. 3,611,419, U.S. Pat. No. 4,240,084, U.S. Pat. No. 4,569,584, U.S. Pat. No. 2,919,171, U.S. Pat. No. 4,524,371, U.S. Pat. No. 4,619,515, U.S. Pat. No. 4,463,363, U.S. Pat. No. 4,254,424, U.S. Pat. No. 4,538,163, U.S. Pat. No. 4,409,604, U.S. Pat. No. 4,408,214, U.S. Pat. No. 4,365,549, U.S. Pat. No. 4,267,556, U.S. Pat. No. 4,160,257, and U.S. Pat. No. 4,155,093, the disclosures of each of which are totally incorporated herein by reference. Generally, the process entails application of charge in an image pattern with an ionographic or electron beam writing head to a dielectric receiver that retains the charged image. The image is subsequently developed with a developer capable of developing charge images.

Many methods are known for applying the electroscopic particles to the electrostatic latent image to be developed. One development method, disclosed in U.S. Pat. No. 2,618,552, the disclosure of which is totally incorporated herein by reference, is known as cascade development. Another technique for developing electrostatic images is the magnetic brush process, disclosed in U.S. Pat. No. 2,874,063. This method entails the carrying of a developer material containing toner and magnetic carrier particles by a magnet. The magnetic field of the magnet causes alignment of the magnetic carriers in a brushlike configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. Other techniques, such as touchdown development, powder cloud development, and jumping development are known to be suitable for developing electrostatic latent images.

Powder development systems normally fall into two classes: two component, in which the developer material comprises magnetic carrier granules having toner particles adhering triboelectrically thereto, and single component, which typically uses toner only. Toner particles are attracted to the latent image, forming a toner powder image. The operating latitude of a powder xerographic development system is determined to a great degree by the ease with which toner particles are supplied to an electrostatic image. Placing charge on the particles, to enable movement and imagewise development via electric fields, is most often accomplished with triboelectricity.

Numerous processes are within the purview of those skilled in the art for the preparation of toners. Emulsion aggregation (EA) is one such method. Emulsion aggregation toners can be used in forming print and/or xerographic images. Emulsion aggregation techniques can entail the formation of an emulsion latex of the resin particles by heating the resin, using emulsion polymerization, as disclosed in, for example, U.S. Pat. No. 5,853,943, the disclosure of which is totally incorporated herein by reference. Other examples of emulsion/aggregation/coalescing processes for the preparation of toners are illustrated in, for example, U.S. Pat. Nos. 5,278,020, 5,290,654, 5,302,486, 5,308,734, 5,344,738, 5,346,797, 5,348,832, 5,364,729, 5,366,841, 5,370,963, 5,403,693, 5,405,728, 5,418,108, 5,496,676, 5,501,935, 5,527,658, 5,585,215, 5,650,255, 5,650,256, 5,723,253, 5,744,520, 5,763,133, 5,766,818, 5,747,215, 5,804,349, 5,827,633, 5,840,462, 5,853,944, 5,869,215, 5,863,698; 5,902,710; 5,910,387; 5,916,725; 5,919,595; 5,925,488, 5,977,210, 5,994,020, and U.S. Patent Application Publication No. 2008/01017989, the disclosures of which are totally incorporated herein by reference.

Polyester EA ultra low melt (ULM) toners have been prepared utilizing amorphous and crystalline polyester resins as disclosed in, for example, U.S. Patent Publication 2008/0153027, the disclosure of which is totally incorporated herein by reference.

Two exemplary emulsion aggregation toners include acrylate based toners, such as those based on styrene acrylate toner particles as illustrated in, for example, U.S. Pat. No. 6,120,967, and polyester toner particles, as disclosed in, for example, U.S. Pat. No. 5,916,725, U.S. Patent Publication 2008/0090163, and U.S. Patent Publication 2008/0107989, the disclosures of each of which are totally incorporated herein by reference.

While known compositions and processes are suitable for their intended purposes, a need remains for improved toner compositions. In addition, a need remains for toners with improved charging performance, particularly in A-zone. Further, a need remains for toners with improved relative humidity insensitivity. Additionally, a need remains for toners with more hydrophobic surface characteristics. There is also a need for toners with lowered surface energy on the particle surfaces. In addition, there is a need for toners with improved flow properties. Further, there is a need for toners with reduced particle-to-particle cohesion. Additionally, there is a need for toners that exhibit reduced blocking, particularly when ambient temperatures rise.

SUMMARY

Disclosed herein is a toner composition comprising toner particles which comprise a resin, an optional colorant, and a polyhedral oligomeric silsesquioxane. Another embodiment is directed to a process for preparing toner particles which comprises (a) contacting at least one resin and at least one POSS compound in an emulsion; (b) contacting the emulsion with an optional colorant dispersion, an optional wax, and an optional coagulant to form a mixture; (c) aggregating small particles in the mixture to form a plurality of larger aggregates; and (d) coalescing the larger aggregates to form toner particles. Yet another embodiment is directed to a process for preparing toner particles which comprises (a) contacting at least one resin in an emulsion; (b) contacting the emulsion with an optional colorant dispersion, an optional wax, and an optional coagulant to form a mixture; (c) aggregating small particles in the mixture to form a plurality of larger aggregates; (d) forming a second emulsion by contacting at least one shell resin and at least one POSS compound in the emulsion; (e) contacting the larger aggregates with the second emulsion to form a shell over the larger aggregates; and (f) coalescing the larger aggregates to form toner particles.

DETAILED DESCRIPTION

The toners disclosed herein can be prepared from any desired or suitable resins suitable for use in forming a toner. Such resins, in turn, can be made of any suitable monomer or monomers. Suitable monomers useful in forming the resin include, but are not limited to, styrenes, acrylates, methacrylates, butadienes, isoprenes, acrylic acids, methacrylic acids, acrylonitriles, esters, diols, diacids, diamines, diesters, diisocyanates, mixtures thereof, and the like.

Examples of suitable resins include styrene acrylates, styrene butadienes, styrene methacrylates, and more specifically, poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and the like, as well as mixtures thereof.

In another embodiment, the resin is a polyester. Examples of suitable polyester resins include, but are not limited to, sulfonated, non-sulfonated, crystalline, amorphous, combinations thereof, and the like. The polyester resins can be linear, branched, combinations thereof, and the like. Polyester resins can include those resins disclosed in U.S. Pat. Nos. 6,593,049 and 6,756,176, the disclosures of each of which are totally incorporated herein by reference. Suitable resins also include mixtures of amorphous polyester resins and crystalline polyester resins as disclosed in U.S. Pat. No. 6,830,860, the disclosure of which is totally incorporated herein by reference.

Other examples of suitable polyesters include those formed by reacting a diol with a diacid or diester in the presence of an optional catalyst. For forming a crystalline polyester, suitable organic diols include, but are not limited to, aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol can be selected in any desired or effective amount, in one embodiment at least about 40 mole percent, in another embodiment at least about 42 mole percent and in yet another embodiment at least about 45 mole percent, and in one embodiment no more than about 60 mole percent, in another embodiment no more than about 55 mole percent, and in yet another embodiment no more than about 53 mole percent, and the alkali sulfo-aliphatic diol can be selected in any desired or effective amount, in one embodiment 0 mole percent, and in another embodiment no more than about 1 mole percent, and in one embodiment no more than about 10 mole percent, and in another embodiment no more than from about 4 mole percent of the resin, although the amounts can be outside of these ranges.

Examples of suitable organic diacids or diesters for preparation of crystalline resins include, but are not limited to, oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and the like, as well as combinations thereof. The organic diacid can be selected in any desired or effective amount, in one embodiment at least about 40 mole percent, in another embodiment at least about 42 mole percent, and in yet another embodiment at least about 45 mole percent, and in one embodiment no more than about 60 mole percent, in another embodiment no more than about 55 mole percent, and in yet another embodiment no more than about 53 mole percent, although the amounts can be outside of these ranges.

Examples of suitable crystalline resins include, but are not limited to, polyesters, polyamides, polyimides, polyolefins, polyethylene, polybutylene, polyisobutyrate, ethylene-propylene copolymers, ethylene-vinyl acetate copolymers, polypropylene, and the like, as well as mixtures thereof. Specific crystalline resins can be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and the like, as well as mixtures thereof. The crystalline resin can be present in any desired or effective amount, in one embodiment at least about 5 percent by weight of the toner components, and in another embodiment at least about 10 percent by weight of the toner components, and in one embodiment no more than about 50 percent by weight of the toner components, and in another embodiment no more than about 35 percent by weight of the toner components, although the amounts can be outside of these ranges. The crystalline resin can possess any desired or effective melting point, in one embodiment at least about 30° C., and in another embodiment at least about 50° C., and in one embodiment no more than about 120° C., and in another embodiment no more than about 90° C., although the melting point can be outside of these ranges. The crystalline resin can have any desired or effective number average molecular weight (Mn), as measured by gel permeation chromatography (GPC), in one embodiment at least about 1,000, in another embodiment at least about 2,000, and in one embodiment no more than about 50,000, and in another embodiment no more than about 25,000, although the Mn can be outside of these ranges, and any desired or effective weight average molecular weight (Mw), in one embodiment at least about 2,000, and in another embodiment at least about 3,000, and in one embodiment no more than about 100,000, and in another embodiment no more than about 80,000, although the Mw can be outside of these ranges, as determined by Gel Permeation Chromatography using polystyrene standards. The molecular weight distribution (Mw/Mn) of the crystalline resin can be of any desired or effective number, in one embodiment at least about 2, and in another embodiment at least about 3, and in one embodiment no more than about 6, and in another embodiment no more than about 4, although the molecular weight distribution can be outside of these ranges.

Examples of suitable diacid or diesters for preparation of amorphous polyesters include, but are not limited to, dicarboxylic acids, anhydrides, or diesters, such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and the like, as well as mixtures thereof. The organic diacid or diester can be present in any desired or effective amount, in one embodiment at least about 40 mole percent, in another embodiment at least about 42 mole percent, and in yet another embodiment at least about 45 mole percent, and in one embodiment no more than about 60 mole percent, in another embodiment no more than about 55 mole percent, and in yet another embodiment no more than about 53 mole percent of the resin, although the amounts can be outside of these ranges.

Examples of suitable diols for generating amorphous polyesters include, but are not limited to, 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and the like, as well as mixtures thereof. The organic diol can be present in any desired or effective amount, in one embodiment at least about 40 mole percent, in another embodiment at least about 42 mole percent, and in yet another embodiment at least about 45 mole percent, and in one embodiment no more than about 60 mole percent, in another embodiment no more than about 55 mole percent, and in yet another embodiment no more than about 53 mole percent of the resin, although the amounts can be outside of these ranges.

Polycondensation catalysts which can be used for preparation of either the crystalline or the amorphous polyesters include, but are not limited to, tetraalkyl titanates, dialkyltin oxides such as dibutyltin oxide, tetraalkyltins such as dibutyltin dilaurate, dialkyltin oxide hydroxides such as butyltin oxide hydroxide, aluminum alkoxides, alkyl zinc, dialkyl zinc, zinc oxide, stannous oxide, and the like, as well as mixtures thereof. Such catalysts can be used in any desired or effective amount, in one embodiment at least about 0.01 mole percent, and in one embodiment no more than about 5 mole percent based on the starting diacid or diester used to generate the polyester resin, although the amounts can be outside of these ranges.

Examples of suitable amorphous resins include polyesters, polyamides, polyimides, polyolefins, polyethylene, polybutylene, polyisobutyrate, ethylene-propylene copolymers, ethylene-vinyl acetate copolymers, polypropylene, and the like, as well as mixtures thereof. Specific examples of amorphous resins which can be used include, but are not limited to, poly(styrene-acrylate) resins, crosslinked, for example, from about 10 percent to about 70 percent, poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated poly(styrene-acrylate) resins, poly(styrene-methacrylate) resins, crosslinked alkali sulfonated-poly(styrene-methacrylate) resins, alkali sulfonated-poly(styrene-butadiene) resins, crosslinked alkali sulfonated poly(styrene-butadiene) resins, and the like, as well as mixtures thereof. Alkali sulfonated polyester resins can be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), and the like, as well as mixtures thereof.

Unsaturated polyester resins can also be used. Examples of such resins include those disclosed in U.S. Pat. No. 6,063,827, the disclosure of which is totally incorporated herein by reference. Exemplary unsaturated polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and the like, as well as mixtures thereof.

One specific suitable amorphous polyester resin is a poly (propoxylated bisphenol A co-fumarate) resin having the following formula:

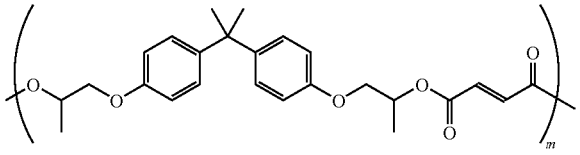

wherein m can be from about 5 to about 1000, although m can be outside of this range. Examples of such resins and processes for their production include those disclosed in U.S. Pat. No. 6,063,827, the disclosure of which is totally incorporated herein by reference.

Also suitable are the polyester resins disclosed in U.S. Patent Publication 2007/0135615, the disclosure of which is totally incorporated herein by reference. Specific examples of suitable resins include (1) the polycondensation products of mixtures of the following diacids:

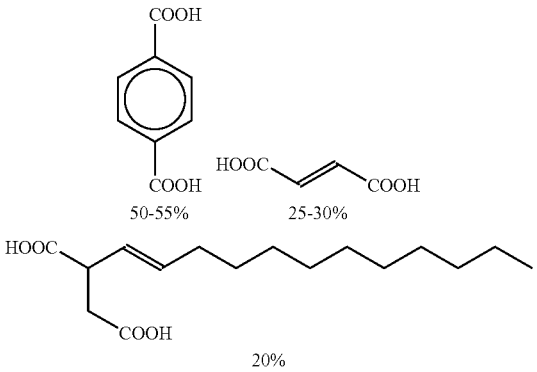

and the following diols:

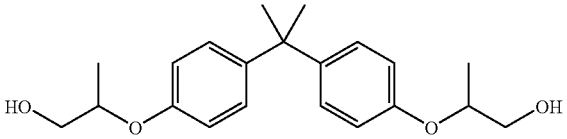

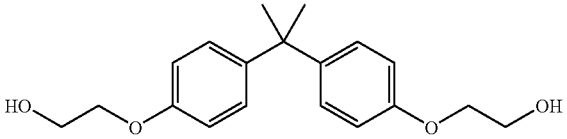

and (2) the polycondensation products of mixtures of the following diacids:

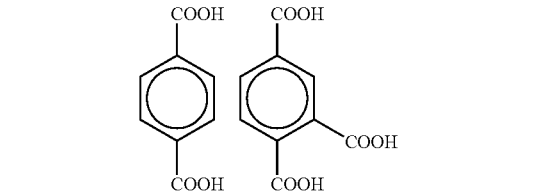

and the following diols:

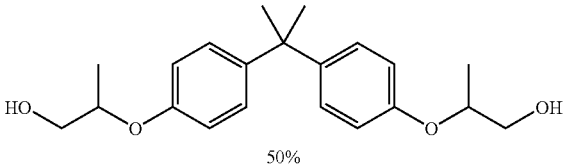

-continued

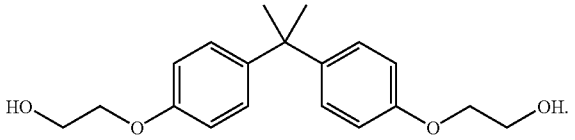

50%

One example of a linear propoxylated bisphenol A fumarate resin which can be used as a latex resin is available under the trade name SPARII from Resana S/A Industrias Quimicas, Sao Paulo Brazil. Other propoxylated bisphenol A fumarate resins that can be used and are commercially available include GTUF and FPESL-2 from Kao Corporation, Japan, and EM181635 from Reichhold, Research Triangle Park, N.C., and the like.

Suitable crystalline resins also include those disclosed in U.S. Patent Publication 2006/0222991, the disclosure of which is totally incorporated herein by reference. One specific suitable crystalline resin comprises ethylene glycol and a mixture of dodecanedioic acid and fumaric acid co-monomers with the following formula:

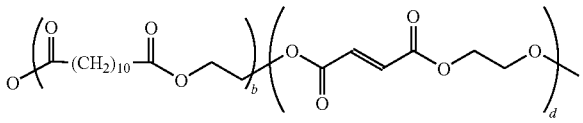

wherein b is from about 5 to about 2000 and d is from about 5 to about 2000, although the values of b and d can be outside of these ranges. Another suitable crystalline resin is of the formula

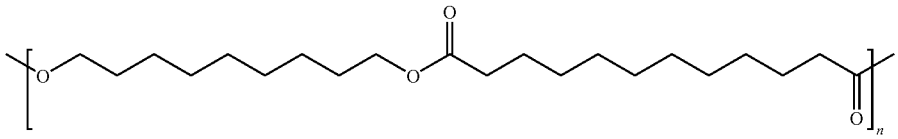

wherein n represents the number of repeat monomer units.

Examples of other suitable latex resins or polymers which can be used include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and the like, as well as mixtures thereof. The polymers can be block, random, or alternating copolymers, as well as combinations thereof.

Examples of suitable waxes include (but are not limited to) those having, for example, a weight average molecular weight of in one embodiment at least about 500, and in another embodiment at least about 1,000, and in one embodiment no more than about 20,000, and in another embodiment no more than about 10,000, although the weight average molecular weight can be outside of these ranges. Examples of suitable waxes include, but are not limited to, polyolefins, such as polyethylene, polypropylene, and polybutene waxes, including those commercially available from Allied Chemical and Petrolite Corporation, for example POLYWAX™ polyethylene waxes from Baker Petrolite, wax emulsions available from Michaelman, Inc. and Daniels Products Company, EPOLENE N-15™ commercially available from Eastman Chemical Products, Inc., and VISCOL 550-P™, a low weight average molecular weight polypropylene available from Sanyo Kasei K. K., and the like; plant-based waxes, such as carnauba wax, rice wax, candelilla wax, sumacs wax, jojoba oil, and the like; animal-based waxes, such as beeswax and the like; mineral-based waxes and petroleum-based waxes, such as montan wax, ozokerite, ceresin, paraffin wax, microcrystalline wax, Fischer-Tropsch wax, and the like; ester waxes obtained from higher fatty acids and higher alcohols, such as stearyl stearate, behenyl behenate, and the like; ester waxes obtained from higher fatty acid and monovalent or multivalent lower alcohols, such as butyl stearate, propyl oleate, glyceride monostearate, glyceride distearate, pentaerythritol tetrabehenate, and the like; ester waxes obtained from higher fatty acids and multivalent alcohol multimers, such as diethyleneglycol monostearate, dipropyleneglycol distearate, diglyceryl distearate, triglyceryl tetrastearate, and the like; sorbitan higher fatty acid ester waxes, such as sorbitan monostearate and the like; and cholesterol higher fatty acid ester waxes, such as cholesteryl stearate and the like; and the like, as well as mixtures thereof. Examples of suitable functionalized waxes include, but are not limited to, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated amide waxes, for example MICROSPERSION 19™ available from Micro Powder Inc., imides, esters, quaternary amines, carboxylic acids or acrylic polymer emulsions, for example JONCRYL 74™, 89™, 130™, 537™, and 538™, all available from SC Johnson Wax, chlorinated polypropylenes and polyethylenes available from Allied Chemical and Petrolite Corporation and SC Johnson wax, and the like, as well as mixtures thereof. Mixtures and combinations of the foregoing waxes can also be used. Waxes can be included as, for example, fuser roll release agents.

The toner particles can be prepared by any desired or effective method. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are totally incorporated herein by reference. Toner compositions and toner particles can be prepared by aggregation and coalescence processes in which small-size resin particles are aggregated to the appropriate toner particle size and then coalesced to achieve the final toner-particle shape and morphology.

Toner compositions can be prepared by emulsion-aggregation processes that include aggregating a mixture of an optional colorant, an optional wax, any other desired or required additives, and emulsions including the selected resins described above, optionally in surfactants as described above, and then coalescing the aggregate mixture. A mixture can be prepared by adding an optional colorant and optionally a wax or other materials, which can also be optionally in a dispersion(s) including a surfactant, to the emulsion, which can also be a mixture of two or more emulsions containing the resin. Additionally, if desired, the mixture can be homogenized. If the mixture is homogenized, homogenization can be performed by mixing at from about 600 to about 4,000 revolutions per minute, although the speed of mixing can be outside of this range. Homogenization can be performed by any desired or effective method, for example, with an IKA ULTRA TURRAX T50 probe homogenizer.

Following preparation of the above mixture, an aggregating agent can be added to the mixture. Any desired or effective aggregating agent can be used to form a toner. Suitable aggregating agents include, but are not limited to, aqueous solutions of divalent cations or a multivalent cations. Specific examples of aggregating agents include polyaluminum halides such as polyaluminum chloride (PAC), or the corresponding bromide, fluoride, or iodide, polyaluminum silicates, such as polyaluminum sulfosilicate (PASS), and water soluble metal salts, including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and the like, as well as mixtures thereof. In specific embodiments, the aggregating agent can be added to the mixture at a temperature below the glass transition temperature (Tg) of the resin.

The aggregating agent can be added to the mixture used to form a toner in any desired or effective amount, in one embodiment at least about 0.1 percent by weight, in another embodiment at least about 0.2 percent by weight, and in yet another embodiment at least about 0.5 percent by weight, and in one embodiment no more than about 8 percent by weight, and in another embodiment no more than about 5 percent weight of the resin in the mixture, although the amounts can be outside of these ranges.

To control aggregation and coalescence of the particles, the aggregating agent can, if desired, be metered into the mixture over time. For example, the agent can be metered into the mixture over a period of in one embodiment at least about 5 minutes, and in another embodiment at least about 30 minutes, and in one embodiment no more than about 240 minutes, and in another embodiment no more than about 200 minutes, although more or less time can be used. The addition of the agent can also be performed while the mixture is maintained under stirred conditions, in one embodiment at least about 50 rpm, and in another embodiment at least about 100 rpm, and in one embodiment no more than about 1,000 rpm, and in another embodiment no more than about 500 rpm, although the mixing speed can be outside of these ranges, and, in some specific embodiments, at a temperature that is below the glass transition temperature of the resin as discussed above, in one specific embodiment at least about 30° C., in another specific embodiment at least about 35° C., and in one specific embodiment no more than about 90° C., and in another specific embodiment no more than about 70° C., although the temperature can be outside of these ranges.

The particles can be permitted to aggregate until a predetermined desired particle size is obtained. A predetermined desired size refers to the desired particle size to be obtained as determined prior to formation, with the particle size being monitored during the growth process until this particle size is reached. Samples can be taken during the growth process and analyzed, for example with a Coulter Counter, for average particle size. Aggregation can thus proceed by maintaining the elevated temperature, or by slowly raising the temperature to, for example, from about 40° C. to about 100° C. (although the temperature can be outside of this range), and holding the mixture at this temperature for a time from about 0.5 hours to about 6 hours, in embodiments from about hour 1 to about 5 hours (although time periods outside of these ranges can be used), while maintaining stirring, to provide the aggregated particles. Once the predetermined desired particle size is reached, the growth process is halted. In embodiments, the predetermined desired particle size is within the toner particle size ranges mentioned above.

The growth and shaping of the particles following addition of the aggregation agent can be performed under any suitable conditions. For example, the growth and shaping can be conducted under conditions in which aggregation occurs separate from coalescence. For separate aggregation and coalescence stages, the aggregation process can be conducted under shearing conditions at an elevated temperature, for example of from about 40° C. to about 90° C., in embodiments from about 45° C. to about 80° C., which may be below the glass transition temperature of the resin as discussed above.

An optional shell can then be applied to the formed aggregated toner particles. Any resin described above as suitable for the core resin can be used as the shell resin. The shell resin can be applied to the aggregated particles by any desired or effective method. For example, the shell resin can be in an emulsion, including any surfactant described above. The aggregated particles described above can be combined with said shell resin emulsion so that the shell resin forms a shell over the formed aggregates. In one specific embodiment, an amorphous polyester can be used to form a shell over the aggregates to form toner particles having a core-shell configuration.

Polyhedral oligomeric silsesquioxanes (POSS) include compounds with the generic formula $(RSiO_{1.5})_n$ wherein R can be any of various hydrocarbons, siloxanes, functional groups, or the like, the R groups can be the same as or different from one another, and n is 6, 8, 10, 12, or higher. The silicon-oxygen framework in POSS molecules generally contains multiple ring structures in which each silicon atom is bound to one organic group and three oxygen atoms to form a fully condensed polycyclic structure. For example, when n is 8, structures as follows can form:

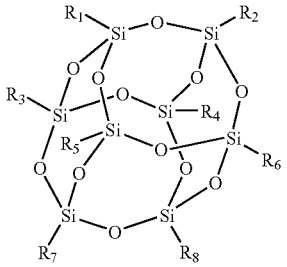

wherein $R_1$, $R_2$, $R_3$, $R_4$, $R_5$, $R_6$, $R_7$, and $R_8$ can be the same as or different from one another and are, for example, alkyl groups, including linear, branched, saturated, unsaturated, cyclic, acyclic, substituted, and unsubstituted alkyl groups, and wherein hetero atoms, such as oxygen, nitrogen, sulfur, silicon, phosphorus, boron, and the like either may or may not be present in the alkyl group, in one embodiment with at least 1 carbon atom, in another embodiment with at least about 6 carbon atoms, and in yet another embodiment with at least about 12 carbon atoms, and in one embodiment with no more than about 36 carbon atoms, in another embodiment with no more than about 24 carbon atoms, and in yet another embodiment with no more than about 18 carbon atoms, although the number of carbon atoms can be outside of these ranges, aryl groups, including substituted and unsubstituted aryl groups, and wherein hetero atoms, such as oxygen, nitrogen, sulfur, silicon, phosphorus, boron, and the like either may or may not be present in the aryl group, in one embodiment with at least 5 carbon atoms, in another embodiment with at least about 6 carbon atoms, and in yet another embodiment with at least about 12 carbon atoms, and in one embodiment with no more than about 36 carbon atoms, in another embodiment with no more than about 24 carbon atoms, and in yet another embodiment with no more than about 18 carbon atoms, although the number of carbon atoms can be outside of these ranges, arylalkyl groups, including unsubstituted and substituted arylalkyl groups, wherein the alkyl portion of the arylalkyl group can be linear, branched, saturated, unsaturated, cyclic, and/or acyclic, and wherein hetero atoms, such as oxygen, nitrogen, sulfur, silicon, phosphorus, boron, and the like either may or may not be present in either or both of the alkyl portion and the aryl portion of the arylalkyl group, in one embodiment with at least 6 carbon atoms, in another embodiment with at least about 7 carbon atoms, and in yet another embodiment with at least about 12 carbon atoms, and in one embodiment with no more than about 36 carbon atoms, in another embodiment with no more than about 24 carbon atoms, and in yet another embodiment with no more than about 18 carbon atoms, although the number of carbon atoms can be outside of these ranges, such as benzyl and the like, alkylaryl groups, including unsubstituted and substituted alkylaryl groups, wherein the alkyl portion of the alkylaryl group can be linear, branched, saturated, unsaturated, cyclic, and/or acyclic, and wherein hetero atoms, such as oxygen, nitrogen, sulfur, silicon, phosphorus, boron, and the like either may or may not be present in either or both of the alkyl portion and the aryl portion of the alkylaryl group, in one embodiment with at least 6 carbon atoms, in another embodiment with at least about 7 carbon atoms, and in yet another embodiment with at least about 12 carbon atoms, and in one embodiment with no more than about 36 carbon atoms, in another embodiment with no more than about 24 carbon atoms, and in yet another embodiment with no more than about 18 carbon atoms, although the number of carbon atoms can be outside of these ranges, such as tolyl and the like, siloxyl, silyl, and silane groups, including those that are linear, branched, cyclic, acyclic, substituted, and unsubstituted, and wherein hetero atoms, such as oxygen, nitrogen, sulfur, phosphorus, boron, and the like either may or may not be present, in one embodiment with at least 1 silicon atom, and in another embodiment with at least about 3 silicon atoms, and in one embodiment with no more than about 12 silicon atoms, in another embodiment with no more than about 6 silicon atoms, although the number of silicon atoms can be outside of these ranges, wherein the substituents on the alkyl, aryl, arylalkyl, alkylaryl, siloxyl, silyl, and silane groups can be (but are not limited to) hydroxy groups, halogen atoms, amine groups, imine groups, ammonium groups, cyano groups, pyridine groups, pyridinium groups, ether groups, epoxy groups, aldehyde groups, ketone groups, ester groups, amide groups, carbonyl groups, thiocarbonyl groups, sulfate groups, sulfonate groups, sulfonic acid groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, azo groups, cyanato groups, isocyanato groups, thiocyanato groups, isothiocyanato groups, carboxylate groups, carboxylic acid groups, urethane groups, urea groups, alkyl groups, aryl groups, arylalkyl groups, alkylaryl groups, silyl groups, siloxyl groups, silane groups, mixtures thereof, and the like, wherein two or more R groups and/or substituents can be joined together to form a ring. The R groups can also be a variety of functional groups, including, but not limited to, alcohol (hydroxyl), amine, carboxylic acid, epoxide, fluoroalkyl, halide, imide, acrylate, methacrylate, nitrile, sulfonate, thiol, silanol, oxide, and the like, as well as mixtures thereof. When n is 6, the corresponding structure has $R_1$, $R_2$, $R_3$, $R_4$, $R_5$, and $R_6$ groups as defined hereinabove for when n is 8. When n is 10, the corresponding structure has $R_1$, $R_2$, $R_3$, $R_4$, $R_5$, $R_6$, $R_7$, $R_8$, $R_9$, and $R_{10}$ groups as defined hereinabove for when n is 8. When n is 12, the corresponding structure has $R_1$, $R_2$, $R_3$, $R_4$, $R_5$, $R_6$, $R_7$, $R_8$, $R_9$, $R_{10}$, $R_{11}$, and $R_{12}$ groups as defined hereinabove for when n is 8. Also included are compounds wherein one or more of the bonds forming the "cage" structure are opened, allowing the silicon and oxygen atoms to have additional substituents thereon, thus:

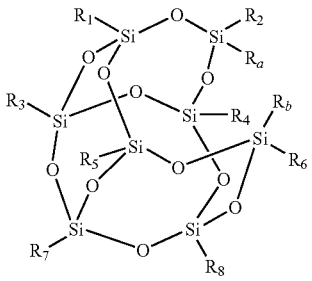

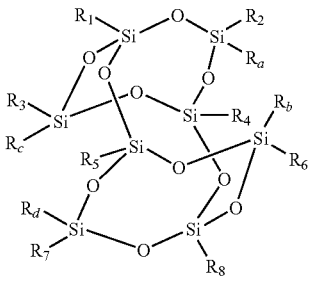

wherein $R_a$, $R_b$, $R_c$, and $R_d$ can have the same definitions as $R_1$ through $R_8$, and can also be substituents, including (but not limited to) imine groups, ammonium groups, cyano groups, pyridine groups, pyridinium groups, sulfate groups, sulfonate groups, sulfonic acid groups, sulfide groups, sulfoxide groups, phosphine groups, phosphonium groups, phosphate groups, nitrile groups, mercapto groups, nitro groups, nitroso groups, sulfone groups, azide groups, azo groups, cyanato groups, isocyanato groups, thiocyanato groups, isothiocyanato groups, urethane groups, urea groups, mixtures thereof, and the like, wherein two or more R groups and/or substituents can be joined together to form a ring. Specific examples of compounds of these structures include (but are not limited to) disilanol POSS compounds and tetrasilanol POSS compounds, such as disilanol isobutyl POSS, of the formula

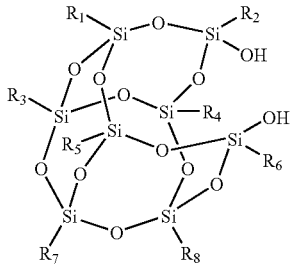

wherein $R_1$, $R_2$, $R_3$, $R_4$, $R_5$, $R_6$, $R_7$, and $R_8$ are all isobutyl, and tetrasilanol phenyl POSS, of the formula

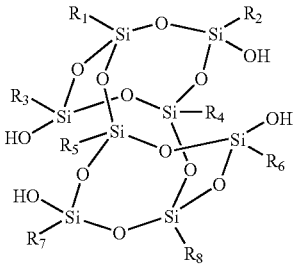

wherein $R_1$, $R_2$, $R_3$, $R_4$, $R_5$, $R_6$, $R_7$, and $R_8$ are all phenyl. Also included are compounds wherein one or more of the silicon atoms and the oxygen atoms bonded thereto are missing, allowing the silicon and oxygen atoms to have additional substituents thereon, thus:

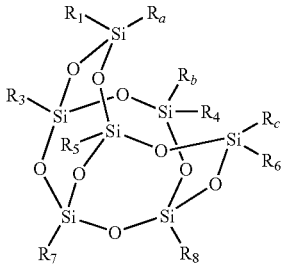

wherein $R_a$, $R_b$, and $R_c$ can have the same definitions as $R_1$ through $R_8$, and can also be substituents, including (but not limited to) hydroxy groups, halogen atoms, amine groups, imine groups, ammonium groups, cyano groups, pyridine groups, pyridinium groups, ether groups, epoxy groups, aldehyde groups, ketone groups, ester groups, amide groups, carbonyl groups, thiocarbonyl groups, sulfate groups, sulfonate groups, sulfonic acid groups, sulfide groups, sulfoxide groups, phosphine groups, phosphonium groups, phosphate groups, nitrile groups, mercapto groups, nitro groups, nitroso groups, sulfone groups, acyl groups, acid anhydride groups, azide groups, azo groups, cyanato groups, isocyanato groups, thiocyanato groups, isothiocyanato groups, carboxylate groups, carboxylic acid groups, urethane groups, urea groups, mixtures thereof, and the like, wherein two or more R groups and/or substituents can be joined together to form a ring. Specific examples of compounds of this structure include (but are not limited to) trisilanol POSS compounds, such as trisilanol phenyl POSS, of the formula

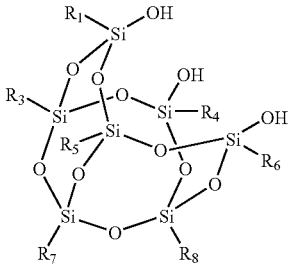

wherein $R_1$, $R_2$, $R_3$, $R_4$, $R_5$, $R_6$, and $R_7$ are all phenyl. Specific examples of suitable R groups include (but are not limited to) phenyl, isobutyl, allyl-bisphenol, cyclopentyl, trimethylsiloxy, methacryl, maleimide, cyclohexyl, and the like. In one specific embodiment, at least one R group is similar to a moiety in one of the toner resins. POSS compounds are commercially available from, for example, Hybrid Plastics, Hattiesburg, Miss.

Specific examples of suitable R groups on the POSS molecules include (but are not limited to) methyl, $O—N(CH_3)_4^+$, ethyl, dibromoethyl, norbornenylethyl, vinyl, trifluoropropyl, chloropropyl, cyanopropyl, mercaptopropyl, aminopropyl, N-methylaminopropyl, propylammonium halide, such as chloride, bromide, iodide, fluoride, and the like, allyl, polyethyleneoxy, of the formula $—(CH_2CH_2(OCH_2CH_2)_m OCH_3$, wherein m is a number representing the number of repeat $OCH_2CH_2$ units, and in one specific embodiment has an average value of about 13.3, isobutyl, cyclopentyl, cyclohexyl, isooctyl, 1-ethyl-3,4-cyclohexanediol, of the formula

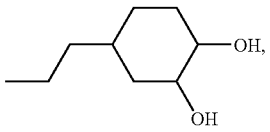

3-hydroxy-3-methylbutyldimethylsiloxyl, of the formula

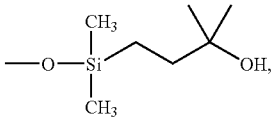

aminoethylaminopropyl, of the formula

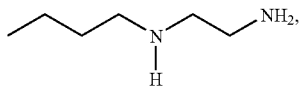

phenyl, chlorobenzyl, chlorobenzylethyl, of the formula

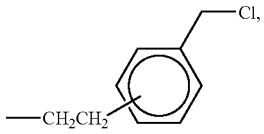

amic acid, of the formula

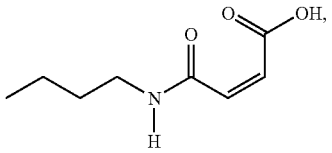

aminophenyl, N-phenylaminopropyl, epoxycyclohexyl, of the formula

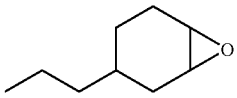

epoxycyclohexyldimethylsilyl, of the formula

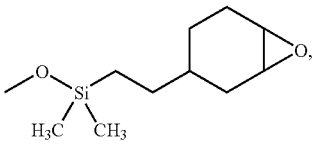

glycidyl, of the formula

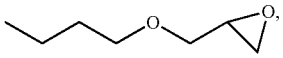

glycidyldimethylsilyl, of the formula

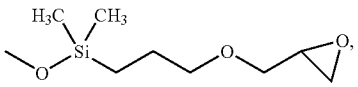

maleimide, of the formula

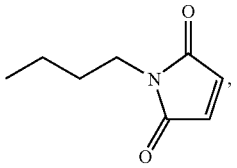

acrylol, of the formula

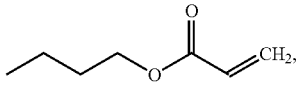

methacryl, of the formula

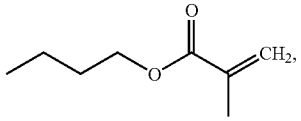

acrylate, of the formula

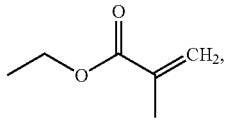

trimethylsiloxyl, of the formula —$OSi(CH_3)_3$, norbornenyl, cyclohexenyldimethylsilyl, of the formula

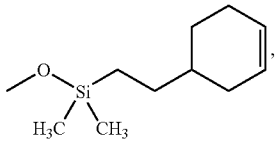

vinyldimethylsilyl, of the formula

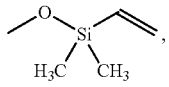

silane, of the formula —$OSi(CH_3)_2H$, —H, —OH,

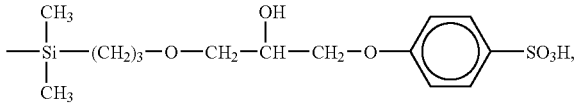

and the like.

The toners disclosed herein contain one or more POSS compounds. In one specific embodiment, the POSS compound or compounds is/are molecularly dissolved or dispersed in one or more of the polymer resins comprising the toner. In another specific embodiment, at least one of the R groups on the POSS molecule can be selected so that it enhances compatibility between the toner polymer(s)/resin(s) and the POSS molecule. While not being limited to any particular theory, it is believed that when dissolved in a toner polymer resin, POSS is only 1 to 3 nanometers in size; it is also believed that the low surface energy of POSS will drive the POSS to migrate to the toner particle surface. It is further believed that the resulting toner will have a more hydrophobic surface compared to a toner not containing POSS, and consequently, that toner charging and RH sensitivity will be improved. Additionally, it is believed that the presence of POSS on the toner particle surface can, in some instances, improve flow properties of the toner by decreasing particle-to-particle cohesion, thereby preventing the toner from blocking, particularly at relatively high ambient temperatures, thereby performing functions typically performed by metal oxide surface additives such as silica, titania, alumina, and the like.

Specific examples of suitable POSS molecules include (but are not limited to) an allyl-bisphenol A cyclopentyl POSS compound wherein n is 8, $R_1$ is

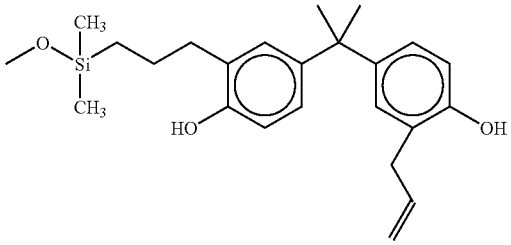

and $R_2$, $R_3$, $R_4$, $R_5$, $R_6$, $R_7$, and $R_8$ are all cyclopentyl, a phenyl isobutyl POSS compound wherein n is 8, $R_1$ is phenyl, and $R_2$, $R_3$, $R_4$, $R_5$, $R_6$, $R_7$, and $R_8$ are all isobutyl, an octaphenyl POSS compound, wherein n is 8 and $R_1$, $R_2$, $R_3$, $R_4$, $R_5$, $R_6$, $R_7$, and $R_8$ are all phenyl, an octatrimethylsiloxy POSS compound, wherein n is 8 and $R_1$, $R_2$, $R_3$, $R_4$, $R_5$, $R_6$, $R_7$, and $R_8$ are all trimethylsiloxy, a methylacrylphenyl POSS compound, wherein n is 8, $R_1$ is

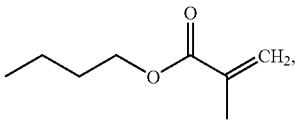

and $R_2$, $R_3$, $R_4$, $R_5$, $R_6$, $R_7$, and $R_8$ are all phenyl, a maleimide cyclohexyl POSS compound, wherein n is 8, $R_1$ is

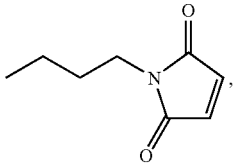

and $R_2$, $R_3$, $R_4$, $R_5$, $R_6$, $R_7$, and $R_8$ are all cyclohexyl, a monoallyl isobutyl POSS compound, wherein n is 8, $R_1$ is

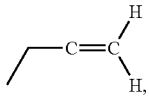

and $R_2$, $R_3$, $R_4$, $R_5$, $R_6$, $R_7$, and $R_8$ are all isobutyl, and the like, a dodecaphenyl POSS compound, wherein n is 12 and $R_1$, $R_2$, $R_3$, $R_4$, $R_5$, $R_6$, $R_7$, $R_8$, $R_9$, $R_{10}$, $R_{11}$, and $R_{12}$ are all phenyl, as well as mixtures thereof. These compounds are commercially available from, for example, Hybrid Plastics, Hattiesburg, Miss.

The POSS compound can be present in the toner in any desired or effective amount. When no shell is employed, in one embodiment, the POSS compound is present in the toner in an amount of at least about 0.5 percent by weight of the toner, in another embodiment at least about 1 percent by weight of the toner, and in yet another embodiment at least about 5 percent by weight of the toner, and in one embodiment no more than about 20 percent by weight of the toner, in another embodiment no more than about 15 percent by weight of the toner, and in yet another embodiment no more than about 10 percent by weight of the toner, although the amount can be outside of these ranges. When a core-shell structure is employed, in one embodiment, the POSS compound is present in the toner shell in an amount of at least about 0.5 percent by weight of the toner shell, in another embodiment at least about 1 percent by weight of the toner shell, and in yet another embodiment at least about 5 percent by weight of the toner shell, and in one embodiment no more than about 50 percent by weight of the toner shell, in another embodiment no more than about 25 percent by weight of the toner shell, and in yet another embodiment no more than about 10 percent by weight of the toner shell, although the amount can be outside of these ranges.

The POSS compound can be incorporated into the toner by any desired or effective method. For example, when an optional shell is employed, the POSS compound can be admixed with the shell resin prior to admixing the shell resin with the aggregated particles. When no shell is employed, the POSS compound can be mixed with a toner resin prior to aggregation to form toner particles comprising the POSS compound. Any suitable method can be used to mix the POSS compound with a toner resin. For example, melt mixing can be used. In other embodiments, solvent flash emulsification can be used to make the POSS/resin mixture by dissolving the POSS compound and a toner resin together in an organic solvent, followed by addition of water under homogenization and distillation of the organic solvent.

Following aggregation to the desired particle size, with the formation of the optional shell as described above, the particles can then be coalesced to the desired final shape, the coalescence being achieved by, for example, heating the mixture to any desired or effective temperature, in one embodiment at least about 55° C., and in another embodiment at least about 65° C., and in one embodiment no more than about 100° C., and in another embodiment no more than about 75° C., and in one specific embodiment about 70° C., although temperatures outside of these ranges can be used, which can be below the melting point of the crystalline resin to prevent plasticization. Higher or lower temperatures may be used, it being understood that the temperature is a function of the resins used for the binder.

Coalescence can proceed and be performed over any desired or effective period of time, in one embodiment at least about 0.1 hour, and in another embodiment at least 0.5 hour, and in one embodiment no more than about 9 hours, and in another embodiment no more than about 4 hours, although periods of time outside of these ranges can be used.

After coalescence, the mixture can be cooled to room temperature, typically from about 20° C. to about 25° C. (although temperatures outside of this range can be used). The cooling can be rapid or slow, as desired. A suitable cooling method can include introducing cold water to a jacket around the reactor. After cooling, the toner particles can be optionally washed with water and then dried. Drying can be accomplished by any suitable method for drying including, for example, freeze-drying.

The toner particles can also contain other optional additives as desired. For example, the toner can include positive or negative charge control agents in any desired or effective amount, in one embodiment in an amount of at least about 0.1 percent by weight of the toner, and in another embodiment at least about 1 percent by weight of the toner, and in one embodiment no more than about 10 percent by weight of the toner, and in another embodiment no more than about 3 percent by weight of the toner, although amounts outside of these ranges can be used. Examples of suitable charge control agents include, but are not limited to, quaternary ammonium compounds inclusive of alkyl pyridinium halides; bisulfates; alkyl pyridinium compounds, including those disclosed in U.S. Pat. No. 4,298,672, the disclosure of which is totally incorporated herein by reference; organic sulfate and sulfonate compositions, including those disclosed in U.S. Pat. No. 4,338,390, the disclosure of which is totally incorporated herein by reference; cetyl pyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the optional shell resin described above or after application of the optional shell resin.

There can also be blended with the toner particles external additive particles, including flow aid additives, which can be present on the surfaces of the toner particles. Examples of these additives include, but are not limited to, metal oxides, such as titanium oxide, silicon oxide, tin oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in one embodiment at least about 0.1 percent by weight of the toner, and in another embodiment at least about 0.25 percent by weight of the toner, and in one embodiment no more than about 5 percent by weight of the toner, and in another embodiment no more than about 3 percent by weight of the toner, although amounts outside these ranges can be used. Suitable additives include, but are not limited to, those disclosed in U.S. Pat. Nos. 3,590,000, 3,800,588, and 6,214,507, the disclosures of each of which are totally incorporated herein by reference. Again, these additives can be applied simultaneously with an optional shell resin described above or after application of an optional shell resin.

In specific embodiments, toners disclosed herein can be used as ultra low melt (ULM) toners. In more specific embodiments, the dry ULM toner particles, exclusive of external surface additives, can have the following characteristics:

(1) Volume average diameter (also referred to as "volume average particle diameter") of in one embodiment at least about 3 microns, in another embodiment at least about 4 microns, and in yet another embodiment at least about 5 microns, and in one embodiment no more than about 20 microns, in another embodiment no more than about 15 microns, and in yet another embodiment no more than about 9 microns, although a volume average diameter outside these ranges can be obtained.

(2) Number Average Geometric Standard Deviation ($GSD_n$) and/or Volume Average Geometric Standard Deviation ($GSD_v$) for volume average particle diameter of in one embodiment at least about 1.05, and in another embodiment at least about 1.1, and in one embodiment no more than about 1.55, in another embodiment no more than about 1.4, and in yet another embodiment no more than about 1.25, although a $GSD_n$ and/or $GSD_v$ outside these ranges can be obtained.

(3) Circularity (measured with, for example, a Sysmex FPIA 2100 analyzer) of in one embodiment at least about 0.9, in another embodiment at least about 0.95, and in yet another embodiment at least about 0.96, and in one embodiment no more than about 1, in another embodiment no more than about 0.985, and in yet another embodiment no more than about 0.98, although a circularity outside these ranges can be obtained.

(4) Glass transition temperature of in one embodiment at least about 40° C., and in another embodiment at least about 55° C., and in one embodiment no more than about 65° C., and in another embodiment no more than about 62° C., although a glass transition temperature outside these ranges can be obtained.

The characteristics of the toner particles can be determined by any desired or effective technique and apparatus. Volume average particle diameter $D_{50v}$, $GSD_v$, and $GSD_n$ can be measured by as a Beckman Coulter Multisizer 3. Representative sampling can occur as follows: a small amount of toner sample, about 1 gram, can be obtained and filtered through a 25 micron screen, then put in isotonic solution to obtain a concentration of about 10 percent, with the sample then run in a Beckman Coulter Multisizer 3. Toners produced as disclosed herein can, in specific embodiments, possess excellent charging characteristics when exposed to extreme relative humidity (RH) conditions. The low-humidity zone (C zone) can be about 10° C./15% RH, while the high humidity zone (A zone) can be about 28° C./85% RH. Toners as disclosed herein can also, in specific embodiments, possess a parent toner charge per mass ratio (Q/M) of from about −3 μC/g to about −35 μC/g, and a final toner charging after surface additive blending of from −10 μC/g to about −45 μC/g, although values outside these ranges can be obtained.

The charging of the toner particles can be enhanced in specific embodiments, so less surface additives may be required, and the final toner charging may thus be higher to meet machine charging requirements.

The toner particles can be formulated into a developer composition. The toner particles can be mixed with carrier particles to achieve a two-component developer composition. The toner concentration in the developer can be of any desired or effective concentration, in one embodiment at least about 1 percent, and in another embodiment at least about 2 percent, and in one embodiment no more than about 25 percent, and in another embodiment no more than about 15 percent by weight of the total weight of the developer, although amounts outside these ranges can be used.

Carrier particles suitable for mixing with the toner include those particles that are capable of triboelectrically obtaining a charge of opposite polarity to that of the toner particles. Illustrative examples of suitable carrier particles include, but are not limited to, granular zircon, granular silicon, glass, steel, nickel, ferrites, iron ferrites, silicon dioxide, those disclosed in U.S. Pat. Nos. 3,847,604, 4,937,166, and 4,935,326, the disclosures of which are totally incorporated herein by reference, and the like, as well as mixtures thereof.

The carrier particles can be used with or without a coating. In some embodiments, the carrier particles can include a core with a coating thereover which can be formed from a mixture of polymers that are not in close proximity in the triboelectric series. The coating can include fluoropolymers, such as polyvinylidene fluoride resins, terpolymers of styrene, methyl methacrylate, and/or silanes, such as triethoxy silane, tetrafluoroethylenes, other known coatings, and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, can be used. In specific embodiments, polyvinylidenefluoride and polymethylmethacrylate (PMMA) can be mixed in any desired or effective proportions, in one embodiment from about 30 to about 70 weight percent to about 70 to about 30 weight percent, and in another embodiment from about 40 to about 60 weight percent to about 60 to about 40 weight percent, although amounts outside these ranges can be used. The coating can have any desired or effective coating weight, in one embodiment at least about 0.1 percent by weight of the carrier, and in another embodiment at least about 0.5 percent by weight of the carrier, and in one embodiment no more than about 5 percent by weight of the carrier, and in another embodiment no more than about 2 percent by weight of the carrier, although amounts outside these ranges can be used.

In specific embodiments, PMMA can optionally be copolymerized with any desired comonomer, so long as the resulting copolymer retains a suitable particle size. Suitable comonomers include, but are not limited to, monoalkyl and dialkyl amines, such as dimethylaminoethyl methacrylate, diethylaminoethyl methacrylate, diisopropylaminoethyl methacrylate, t-butylaminoethyl methacrylate, and the like, as well as mixtures thereof. The carrier particles can be prepared by mixing the carrier core with the polymer in any desired or effective amount, in one embodiment at least about 0.05 percent by weight, and in another embodiment at least about 0.01 percent by weight, and in one embodiment no more than about 10 percent by weight, and in another embodiment no more than about 3 percent by weight, based on the weight of the coated carrier particles (although amounts outside these ranges can be used), until adherence thereof to the carrier core by mechanical impaction and/or electrostatic attraction.

Various effective suitable means can be used to apply the polymer to the surface of the carrier core particles, such as cascade roll mixing, tumbling, milling, shaking, electrostatic powder cloud spraying, fluidized bed, electrostatic disc processing, electrostatic curtain, and the like, as well as combinations thereof. The mixture of carrier core particles and polymer can then be heated to enable the polymer to melt and fuse to the carrier core particles. The coated carrier particles can then be cooled and classified to a desired particle size.

One specific example of a suitable carrier is a steel core, in one embodiment at least about 25 microns in size, in another embodiment at least about 50 microns in size, and in one embodiment no more than about 100 microns in size, and in another embodiment no more than about 75 microns in size, although sizes outside these ranges can be used, coated with in one embodiment at least about 0.5 percent by weight, in another embodiment at least about 0.7 percent by weight, and in one embodiment no more than about 10 percent by weight, and in another embodiment no more than about 5 percent by weight (although amounts outside these ranges can be used) of a conductive polymer mixture including methylacrylate and carbon black using the process described in U.S. Pat. Nos. 5,236,629 and 5,330,874, the disclosures of each of which are totally incorporated herein by reference.

The toner particles can be mixed with the carrier particles in various suitable concentrations to form developers, with the developer containing in one embodiment at least about 1 percent by weight toner particles, and in another embodiment at least about 2 percent by weight toner particles and in one embodiment with the developer containing no more than about 25 percent by weight toner particles, and in another embodiment no more than about 15 percent by weight toner particles (although amounts outside these ranges can be used). However, different toner and carrier percentages may be used to achieve a developer composition with desired characteristics.

The toners disclosed herein can be utilized for electrostatographic or xerographic processes, including those disclosed in U.S. Pat. No. 4,295,990, the disclosure of which is totally incorporated herein by reference. Any known type of image development system can be used in an image developing device, including, but not limited to, magnetic brush development, jumping single-component development, hybrid scavengeless development (HSD), and the like.

Imaging processes include preparing an image with an electrophotographic, electrostatic, or xerographic device including a charging component, an imaging component, a photoconductive component, a developing component, a transfer component, and a fusing component. In specific embodiments, the development component can include a developer prepared by mixing a carrier with a toner composition as described herein. The imaging device can include a high speed printer, a black and white high speed printer, a color printer, and the like.

Once the image is formed with toners/developers via a suitable image development method, the image can then be transferred to an image receiving medium such as paper, transparency material, or the like. In specific embodiments, the toners can be used to develop an image in an image-developing device using a fuser roll member. Fuser roll members are contact fusing devices in which heat and pressure from the roll can be used to fuse the toner to the image-receiving medium. In specific embodiments, the fuser member can be heated to a temperature above the fusing temperature of the toner, in one embodiment at least about 70° C., in another embodiment at least about 80° C., and in yet another embodiment at least about 90° C., and in one embodiment no more than about 160° C., in another embodiment no more than about 150° C., and in yet another embodiment no more than about 140 C (although temperatures outside these ranges can be used), after or during melting onto the image receiving substrate.

In embodiments where the toner resin is crosslinkable, such crosslinking can be performed in any desired or effective manner. For example, the toner resin can be crosslinked during fusing of the toner to the substrate when the toner resin is crosslinkable at the fusing temperature. Crosslinking can also be effected by heating the fused image to a temperature at which the toner resin will be crosslinked, for example in a post-fusing operation. In specific embodiments, crosslinking can be effected at temperatures of in one embodiment about 160° C. or less, in another embodiment from about 70° C. to about 160° C., and in yet another embodiment from about 80° C. to about 140° C., although temperatures outside these ranges can be used.

Specific embodiments will now be described in detail. These examples are intended to be illustrative, and the claims are not limited to the materials, conditions, or process parameters set forth in these embodiments. All parts and percentages are by weight unless otherwise indicated.

Comparative Example 1

Into a 2 liter beaker was added 397.99 grams of an emulsion (17.03 weight percent) of a linear amorphous resin of the formula

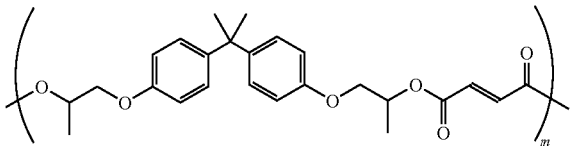

wherein m is from about 5 to about 1000, 74.27 grams of an emulsion (19.98 weight percent) of an unsaturated crystalline polyester resin of the formula

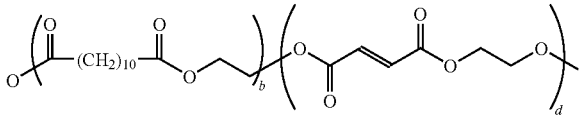

wherein b is from about 5 to about 2000 and d is from about 5 to about 2000, prepared as described in U.S. Patent Publication 2006/0222991, the disclosure of which is totally incorporated herein by reference, and 29.24 grams (17.0 weight percent) of a cyan pigment PB15:3, obtained from Sun Chemical Corporation. 36.0 grams of $Al_2(SO_4)_3$ (1.0 weight percent) was added in as flocculent under homogenization. The mixture was subsequently transferred to a 2 liter Buchi reactor and heated to 45.9° C. for aggregation at 750 rpm. The particle size was monitored with a Coulter Counter until the core particles reached a volume average particle size of 6.83 microns with a GSD of 1.21. Thereafter, 198.29 grams of the above amorphous polyester resin emulsion was added as a shell, resulting in core/shell structured particles with an average particle size of 8.33 microns, GSD 1.21. Subsequently, the pH of the reaction slurry was increased to 6.7 using NaOH, followed by addition of 0.45 pph EDTA (based on dry toner) to freeze the toner particle growth. After freezing particle growth, the reaction mixture was heated for coalescence. The toner had a final particle size of 8.07 microns, GSD 1.22. The toner slurry was then cooled to room temperature, separated by sieving (25 micron), filtered, washed, and freeze dried.

Example I 100 grams of the amorphous resin with the structure indicated in Comparative Example 1 was measured into a 2 liter beaker containing about 735 grams of ethyl acetate. The mixture was stirred at about 250 revolutions per minute and heated to about 67° C. to dissolve the resin in the ethyl acetate. 10 grams of a POSS compound of the formula

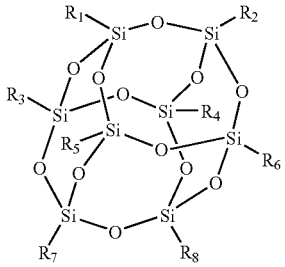

wherein $R_1$ was an allyl bisphenol A group and $R_2$, $R_3$, $R_4$, $R_5$, $R_6$, $R_7$, and $R_8$ were all isobutyl groups, obtained from Hybrid Plastics, Inc., was dissolved in 50 grams of THF at room temperature. The POSS/THF solution was then poured in the above mentioned amorphous resin/ethyl acetate solution. 3.00 grams of sodium bicarbonate and 1.07 gram (46.8 weight percent) of DOWFAX® anionic surfactant, obtained from Dow Chemical Co., were measured into a 4 liter PYREX® glass flask reactor containing about 1,000 grams of deionized water and heated to about 67° C. Homogenization of the heated water solution in the 4 liter glass flask reactor was commenced with an IKA Ultra Turrax T50 homogenizer at 4,000 revolutions per minute. The heated resin/POSS solution was then slowly poured into the water solution. As the mixture continued to be homogenized, the homogenizer speed was increased to 10,000 revolutions per minute and homogenization was carried out at these conditions for about 30 minutes. Upon completion of homogenization, the glass flask reactor and its contents were placed in a heating mantle and connected to a distillation device. The mixture was stirred at about 300 revolutions per minute and the temperature of the mixture was increased to 80° C. at about 1° C. per minute to distill off the ethyl acetate from the mixture. Stirring of the mixture was continued at 80° C. for about 120 minutes, followed by cooling at about 2° C. per minute to room temperature. The resulting resin emulsion contained about 12.97 percent by weight solids in water, and the particles had a volume average diameter of about 127.2 nanometers as measured with a Nanotrac® U2275E particle size analyzer. No phase separation was observed.

Into a 2 liter beaker was then added 155.99 grams of the linear amorphous resin emulsion (43.45 weight percent), 45.03 grams of an emulsion (31.98 weight percent) of the unsaturated crystalline polyester resin of the formula indicated in Comparative Example 1, and 28.53 grams of cyan pigment PB15:3 (17.42 weight percent). 47.79 grams of $Al_2(SO_4)_3$ (1 weight percent) was added in as flocculent under homogenization. The mixture was subsequently transferred to a 2 liter Buchi reactor and heated to 44.3° C. for aggregation at 700 rpm. The particle size was monitored with a Coulter Counter until the core particles reached a volume average particle size of 7.04 microns with a GSD of 1.21 Thereafter, 260.36 grams of the above amorphous resin/POSS emulsion was added as shell, resulting in core-shell structured particles with an average particle size of 8.41 microns, GSD 1.21. Subsequently, the pH of the reaction slurry was increased to 7.1 using NaOH to freeze the toner particle growth. After freezing the particle growth, the reaction mixture was heated to 95° C. for coalescence. The toner had a final particle size of 8.07 microns and GSD of 1.27. The toner slurry was then cooled to room temperature, separated by sieving (25 micron), filtered, washed, and freeze dried.

Testing

Residual elements in the final dried toner were tested by an ICP Spectrometer made by Thermo Instruments (Canada). The results indicated that the toner of Comparative Example 1 contained elemental silicon in an amount of about 3 parts per million, whereas the toner of Example I contained silicon in an amount of about 4,748 parts per million, indicating a significant amount of POSS being incorporated into the toner of Example I.

Charging Evaluation

Toners produced as disclosed herein can exhibit excellent charging characteristics when exposed to extreme relative humidity (RH) conditions. The low-humidity zone (C zone) is about 10° C./15% RH, while the high humidity zone (A zone) is about 28° C./85% RH. A-zone and C-zone charging were measured by a total blow-off apparatus also known as a Barbetta box. Developers were conditioned overnight in A and C zones and then charged using a paint shaker for from about 5 to about 60 minutes to provide information about developer stability with time and between zones. Toners as disclosed herein can exhibit a parent toner charge per mass ratio (Q/M) of from about −3 μC/g to about −35 μC/g, and a final toner charging after surface additive blending of from −5 μC/g to about −50 μC/g. RH sensitivity was determined by the ratio of C zone toner charge and A zone toner charge. Toners as disclosed herein can exhibit a RH sensitivity of from about 1.5 to 15.

| | Parent charging | | | |
|---|---|---|---|---|
| Sample | Q/M AZ 5M-PS | Q/M AZ 60M-PS | Q/M CZ 5M-PS | Q/M CZ 60M-PS |
| Comparative Example 1 | −3.7 | −3.6 | −16.6 | −13.7 |
| Example I | −6.0 | −10.0 | −18.4 | −20.7 |

Q/M = charge per mass ratio

AZ = A-zone 28° C./85% RH

CZ = C-zone 10° C./15% RH

5M-PS = Short developer charging time of 5 minutes

60M-PS = Longer developer charging time of 60 minutes

| | RH sensitivity | |
|---|---|---|
| Sample | Q/M AZ 5M-PS | Q/M AZ 60M-PS |
| Comparative Example 1 | 4.5 | 3.8 |
| Example I | 3.07 | 2.07 |

As the results indicate, charging (both A-zone and C-zone) and relative humidity sensitivity were both improved with the toner containing POSS in the toner shell. While not being limited to any particular theory, it is believed that these improvements may be attributable to reduction of hydrophilicity of the toner surface by incorporation of hydrophobic POSS material in the toner shell.

Example II 100 grams of the amorphous resin with the structure indicated in Comparative Example 1 is measured into a 2 liter beaker containing about 735 grams of ethyl acetate. The mixture is stirred at about 250 revolutions per minute and heated to about 67° C. to dissolve the resin in the ethyl acetate. 10 grams of a POSS compound having one allyl bisphenol A group and seven isobutyl groups, of the formula shown in Example I, available from Hybrid Plastics, Inc., is dissolved in 50 grams of THF at room temperature. The POSS/THF solution is then poured into the above-mentioned amorphous resin/ethyl acetate solution. 3.00 grams of sodium bicarbonate and 1.07 gram (46.8 weight percent) of DOWFAX® (anionic surfactant) are measured into a 4 liter PYREX® glass flask reactor containing about 1,000 grams of deionized water and heated to about 67° C. Homogenization of the heated water solution in the 4 liter glass flask reactor is commenced with an IKA Ultra Turrax T50 homogenizer at 4,000 revolutions per minute. The heated resin/POSS solution is then slowly poured into the water solution. As the mixture continues to be homogenized, the homogenizer speed is increased to 10,000 revolutions per minute and homogenization is carried out at these conditions for about 30 minutes. Upon completion of homogenization, the glass flask reactor and its contents are placed in a heating mantle and connected to a distillation device. The mixture is stirred at about 300 revolutions per minute and the temperature of the mixture is increased to 80° C. at about 1° C. per minute to distill off the ethyl acetate from the mixture. Stirring of the mixture is continued at 80° C. for about 120 minutes, followed by cooling at about 2° C. per minute to room temperature.

Into a 2 liter beaker is then added the above emulsion containing 76.5 grams of linear amorphous resin and 7.65 grams of allyl bisphenol POSS, 37.52 grams of an emulsion (31.98 weight percent) of an unsaturated crystalline polyester resin of the formula indicated in Comparative Example 1, and 21.8 grams of a cyan pigment PB15:3 (17.42 weight percent), available from Sun Chemical Corporation. 30 grams of $Al_2(SO_4)_3$ (1 weight percent) is added in as flocculent under homogenization. The mixture is subsequently transferred to a 2 liter Buchi reactor and heated to about 44° C. for aggregation at 700 rpm. The particle size is monitored with a Coulter Counter until the particles reach a volume average particle size of 8.32 microns with a GSD of 1.21. Subsequently, the pH of the reaction slurry is increased to 7.5 using NaOH to freeze the toner particle growth. After freezing the particle growth, the reaction mixture is heated to 95° C. for coalescence. The toner slurry is then cooled to room temperature, separated by sieving (25 micron), filtered, washed, and freeze dried.

Example III

The process of Example I is repeated except that an equimolar amount of an octatrimethylsiloxy POSS compound, wherein n is 8 and $R_1$, $R_2$, $R_3$, $R_4$, $R_5$, $R_6$, $R_7$, and $R_8$ are all trimethylsiloxy, available from Hybrid Plastics, Inc., is used instead of the allyl bisphenol A isobutyl POSS compound used in Example I. It is believed that similar results will be obtained.

Example IV

The process of Example II is repeated except that an equimolar amount of an octatrimethylsiloxy POSS compound, wherein n is 8 and $R_1$, $R_2$, $R_3$, $R_4$, $R_5$, $R_6$, $R_7$, and $R_8$ are all trimethylsiloxy, available from Hybrid Plastics, Inc., is used instead of the allyl bisphenol A isobutyl POSS compound used in Example II. It is believed that similar results will be obtained.

Example V

The process of Example I is repeated except that an equimolar amount of a methylacrylphenyl POSS compound, wherein n is 8, $R_1$ is

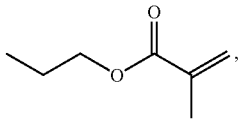

and $R_2$, $R_3$, $R_4$, $R_5$, $R_6$, $R_7$, and $R_8$ are all phenyl, available from Hybrid Plastics, Inc., is used instead of the allyl bisphenol A isobutyl POSS compound used in Example I. It is believed that similar results will be obtained.

Example VI

The process of Example II is repeated except that an equimolar amount of a methylacrylphenyl POSS compound, wherein n is 8, $R_1$ is

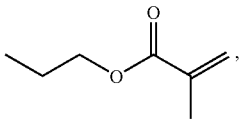

and $R_2$, $R_3$, $R_4$, $R_5$, $R_6$, $R_7$, and $R_8$ are all phenyl, available from Hybrid Plastics, Inc., is used instead of the allyl bisphenol A isobutyl POSS compound used in Example II. It is believed that similar results will be obtained.

Example VII

The process of Example I is repeated except that an equimolar amount of a maleimide cyclohexyl POSS compound, wherein n is 8, $R_1$ is

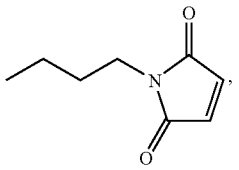

and $R_2$, $R_3$, $R_4$, $R_5$, $R_6$, $R_7$, and $R_8$ are all cyclohexyl, available from Hybrid Plastics, Inc., is used instead of the allyl bisphenol A isobutyl POSS compound used in Example I. It is believed that similar results will be obtained.

Example VIII

The process of Example II is repeated except that an equimolar amount of a maleimide cyclohexyl POSS compound, wherein n is 8, $R_1$ is

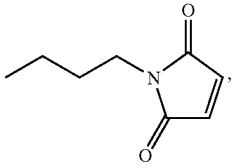

and $R_2$, $R_3$, $R_4$, $R_5$, $R_6$, $R_7$, and $R_8$ are all cyclohexyl, available from Hybrid Plastics, Inc., is used instead of the allyl bisphenol A isobutyl POSS compound used in Example II. It is believed that similar results will be obtained.

Example IX

The process of Example I is repeated except that an equimolar amount of a disilanol isobutyl POSS, of the formula

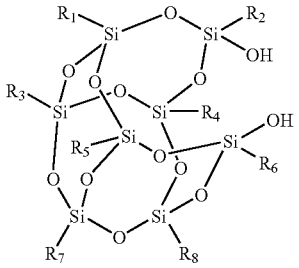

wherein $R_1$, $R_2$, $R_3$, $R_4$, $R_5$, $R_6$, $R_7$, and $R_8$ are all isobutyl, available from Hybrid Plastics, Inc., is used instead of the allyl bisphenol A isobutyl POSS compound used in Example I. It is believed that similar results will be obtained.

Example X

The process of Example II is repeated except that an equimolar amount of a disilanol isobutyl POSS, of the formula

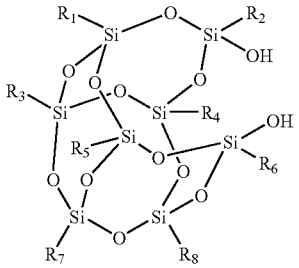

wherein $R_1$, $R_2$, $R_3$, $R_4$, $R_5$, $R_6$, $R_7$, and $R_8$ are all isobutyl, available from Hybrid Plastics, Inc., is used instead of the allyl bisphenol A isobutyl POSS compound used in Example II. It is believed that similar results will be obtained.

Example XI

The process of Example I is repeated except that an equimolar amount of a trisilanol phenyl POSS, of the formula

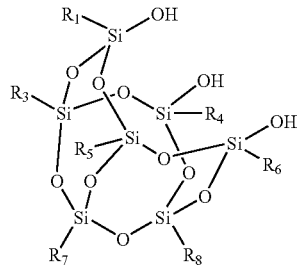

wherein $R_1$, $R_2$, $R_3$, $R_4$, $R_5$, $R_6$, and $R_7$ are all phenyl, available from Hybrid Plastics, Inc., is used instead of the allyl bisphenol A isobutyl POSS compound used in Example I. It is believed that similar results will be obtained.

Example XII

The process of Example II is repeated except that an equimolar amount of a trisilanol phenyl POSS, of the formula

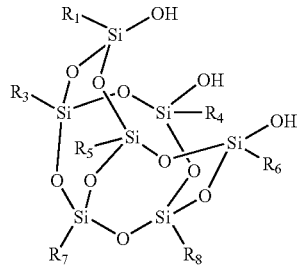

wherein $R_1$, $R_2$, $R_3$, $R_4$, $R_5$, $R_6$, and $R_7$ are all phenyl, available from Hybrid Plastics, Inc., is used instead of the allyl bisphenol A isobutyl POSS compound used in Example II. It is believed that similar results will be obtained.

Example XIII

The process of Example I is repeated except that an equimolar amount of a tetrasilanol phenyl POSS, of the formula

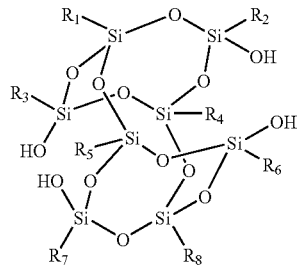

wherein $R_1$, $R_2$, $R_3$, $R_4$, $R_5$, $R_6$, $R_7$, and $R_8$ are all phenyl, available from Hybrid Plastics, Inc., is used instead of the allyl bisphenol A isobutyl POSS compound used in Example I. It is believed that similar results will be obtained.

Example XIV

The process of Example II is repeated except that an equimolar amount of a tetrasilanol phenyl POSS, of the formula

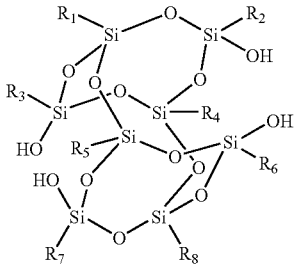

wherein $R_1$, $R_2$, $R_3$, $R_4$, $R_5$, $R_6$, $R_7$, and $R_8$ are all phenyl, available from Hybrid Plastics, Inc., is used instead of the allyl bisphenol A isobutyl POSS compound used in Example II. It is believed that similar results will be obtained.

Example XV

The process of Example I is repeated except that an equimolar amount of a dodecaphenyl POSS compound, wherein n is 12 and $R_1$, $R_2$, $R_3$, $R_4$, $R_5$, $R_6$, $R_7$, $R_8$, $R_9$, $R_{10}$, $R_{11}$, and $R_{12}$ are all phenyl, available from Hybrid Plastics, Inc., is used instead of the allyl bisphenol A isobutyl POSS compound used in Example I. It is believed that similar results will be obtained.

Example XVI

The process of Example II is repeated except that an equimolar amount of a dodecaphenyl POSS compound, wherein n is 12 and $R_1$, $R_2$, $R_3$, $R_4$, $R_5$, $R_6$, $R_7$, $R_8$, $R_9$, $R_{10}$, $R_{11}$, and $R_{12}$ are all phenyl, available from Hybrid Plastics, Inc., is used instead of the allyl bisphenol A isobutyl POSS compound used in Example II. It is believed that similar results will be obtained.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. A toner particle containing a toner composition comprises a resin, an optional colorant, and a polyhedral oligomeric silsesquioxane compound.

2. The toner particle according to claim 1 wherein the resin comprises a polyester.

3. The toner particle according to claim 1 wherein the resin comprises at least one amorphous resin and at least one crystalline resin.

4. The toner particle according to claim 3 wherein the amorphous resin is of the formula

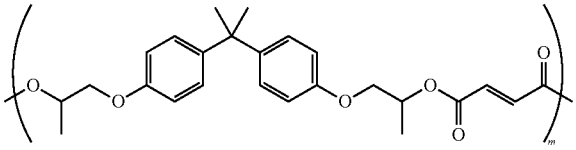

wherein m is from 5 to 1000.

5. The toner particle according to claim 3 wherein the amorphous resin is the polycondensation product of the following diacids:

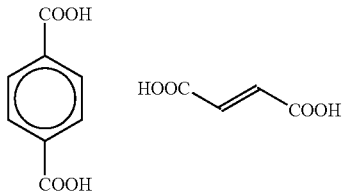

50-55% 25-30%

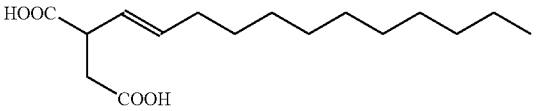

20% and the following diols:

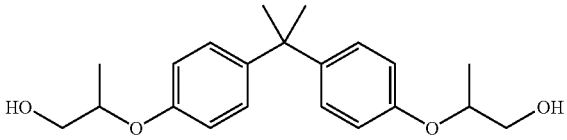

80%

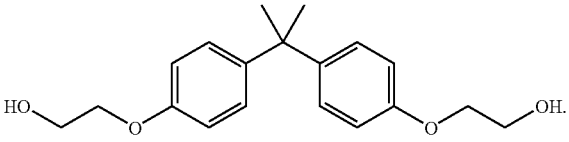

20%

6. The toner particle according to claim 3 wherein the crystalline resin is of the formula

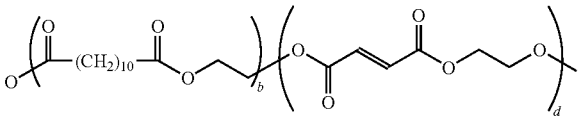

wherein b is from 5 to 2000 and d is from 5 to 2000.

7. The toner particle according to claim 3 wherein the crystalline resin is of the formula

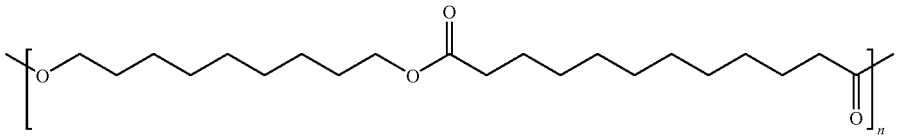

wherein n represents the number of repeat monomer units.

8. The toner particle according to claim 1 wherein the resin comprises a styrene acrylate, a styrene butadiene, a styrene methacrylate, or a combination thereof.

9. The toner particle according to claim 1 wherein the polyhedral oligomeric silsesquioxane is present on at least the surfaces of said toner particles.

10. The toner particle according to claim 1 having a core-shell structure.

11. The toner particle according to claim 1 wherein the toner is prepared by an emulsion aggregation process.

12. The toner particle according to claim 1 wherein the polyhedral oligomeric silsesquioxane compound is present in the toner in an amount of at least 0.5 percent by weight of the toner composition.

13. The toner particle according to claim 1 wherein the polyhedral oligomeric silsesquioxane compound is present in the toner in an amount of no more than about 20 percent by weight of the toner composition.

14. The toner particle according to claim 1 wherein the polyhedral oligomeric silsesquioxane compound is

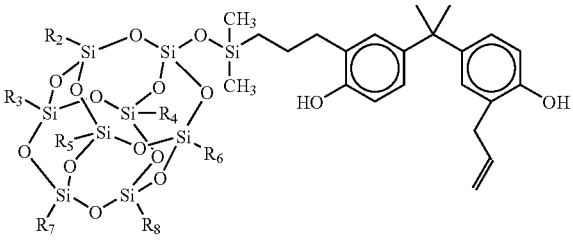

wherein $R_2$, $R_3$, $R_4$, $R_5$, $R_6$, $R_7$, and $R_8$ are all cyclopentyl,

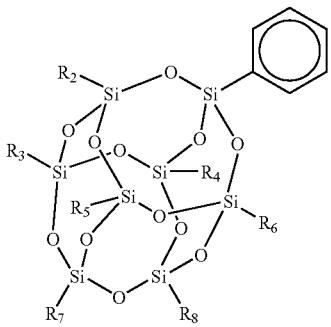

wherein $R_2$, $R_3$, $R_4$, $R_5$, $R_6$, $R_7$, and $R_8$ are all isobutyl,

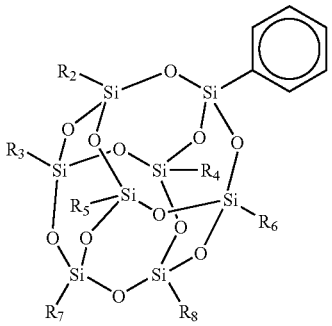

wherein $R_2$, $R_3$, $R_4$, $R_5$, $R_6$, $R_7$, and $R_8$ are all phenyl,

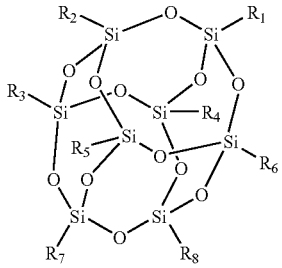

wherein $R_2$, $R_3$, $R_4$, $R_5$, $R_6$, $R_7$, and $R_8$ are all

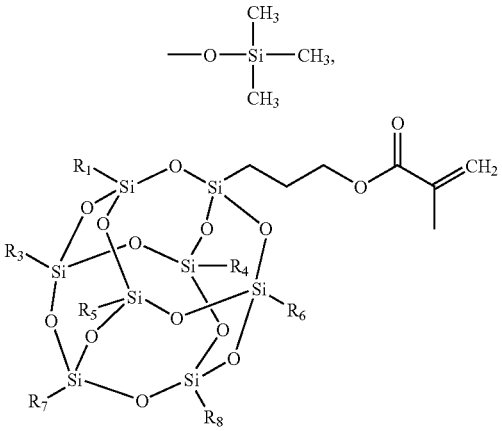

wherein $R_2$, $R_3$, $R_4$, $R_5$, $R_6$, $R_7$, and $R_8$ are all phenyl,

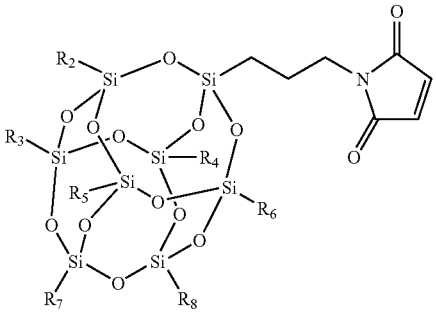

wherein $R_2$, $R_3$, $R_4$, $R_5$, $R_6$, $R_7$, and $R_8$ are all cyclohexyl,

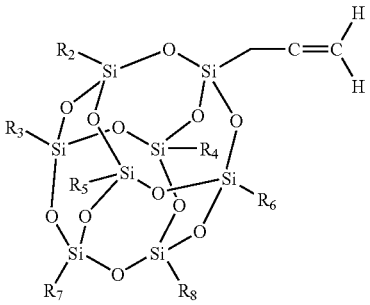

wherein $R_2$, $R_3$, $R_4$, $R_5$, $R_6$, $R_7$, and $R_8$ are all isobutyl,

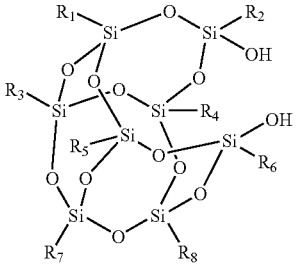

wherein $R_1$, $R_2$, $R_3$, $R_4$, $R_5$, $R_6$, $R_7$, and $R_8$ are all isobutyl,

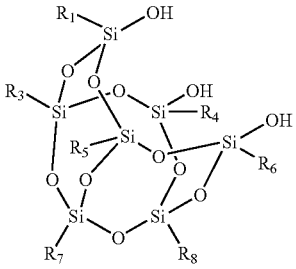

wherein $R_1$, $R_2$, $R_3$, $R_4$, $R_5$, $R_6$, and $R_7$ are all phenyl,

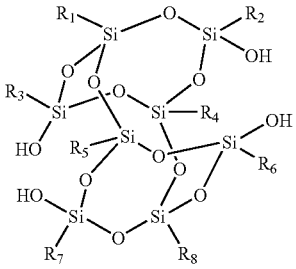

wherein $R_1$, $R_2$, $R_3$, $R_4$, $R_5$, $R_6$, $R_7$, and $R_8$ are all phenyl, or mixtures thereof.

15. The toner particle according to claim 1 further containing a charge control agent.

16. The toner particle according to claim 1 wherein the toner particle have a volume average particle diameter of at least 3 microns.

17. The toner particle according to claim 1 wherein the toner particle have a volume average particle diameter of no more than 20 microns.

18. The toner particle according to claim 1 wherein the toner particle have a particle size distribution of GSD equal to no more than 1.55.

19. The toner particle according to claim 1 containing a pigment colorant.

20. The toner particle according to claim 1 wherein the polyhedral oligomeric silsesquioxane compound is of the formula $(RSiO_{1.5})_n$ wherein n is 6, 8, 10, or 12, each R group, independently of the others, can be the same as the others or different from the others, and each R group, independently of the others, is (a) an alkyl group, including linear, branched, saturated, unsaturated, cyclic, acyclic, substituted, and unsubstituted alkyl groups, and wherein hetero atoms either may or may not be present in the alkyl group, (b) an aryl group, including substituted and unsubstituted aryl groups, and wherein hetero atoms either may or may not be present in the aryl group, (c) an arylalkyl group, including unsubstituted and substituted arylalkyl groups, wherein the alkyl portion of the arylalkyl group can be linear, branched, saturated, unsaturated, cyclic, and/or acyclic, and wherein hetero atoms either may or may not be present in either or both of the alkyl portion and the aryl portion of the arylalkyl group, (d) an alkylaryl group, including unsubstituted and substituted alkylaryl groups, wherein the alkyl portion of the alkylaryl group can be linear, branched, saturated, unsaturated, cyclic, and/or acyclic, and wherein hetero atoms either may or may not be present in either or both of the alkyl portion and the aryl portion of the alkylaryl group, (e) a siloxyl group, including linear, branched, cyclic, acyclic, substituted, and unsubstituted, siloxyl groups, and wherein hetero atoms either may or may not be present, (f) silyl groups, including linear, branched, cyclic, acyclic, substituted, and unsubstituted, silyl groups, and wherein hetero atoms either may or may not be present, (g) silane groups, including linear, branched, cyclic, acyclic, substituted, and unsubstituted, silane groups, and wherein hetero atoms either may or may not be present, or (h) a functional group selected from hydroxyl, amine, carboxylic acid, epoxide, fluoroalkyl, halide, imide, acrylate, methacrylate, nitrile, sulfonate, thiol, silanol, and combinations thereof, wherein two or more R groups can be joined together to form a ring.

21. The toner particle according to claim 1 wherein the polyhedral oligomeric silsesquioxane compound is of the formula

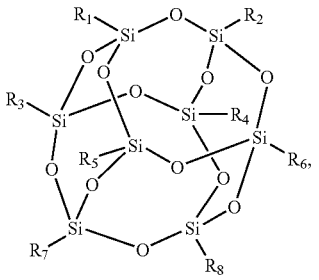

-continued

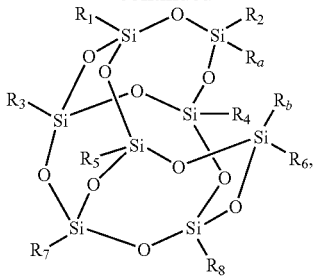

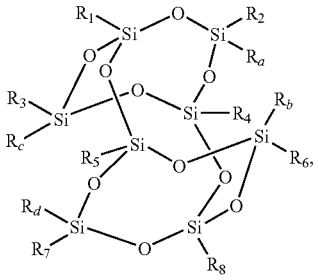

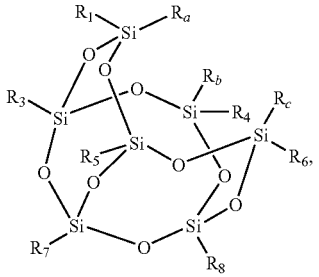

or mixtures thereof, wherein $R_1$, $R_2$, $R_3$, $R_4$, $R_5$, $R_6$, $R_7$, $R_8$, $R_a$, $R_b$, and $R_c$ each, independently of the others are (a) an alkyl group, including linear, branched, saturated, unsaturated, cyclic, acyclic, substituted, and unsubstituted alkyl groups, and wherein hetero atoms either may or may not be present in the alkyl group, (b) an aryl group, including substituted and unsubstituted aryl groups, and wherein hetero atoms either may or may not be present in the aryl group, (c) an arylalkyl group, including unsubstituted and substituted arylalkyl groups, wherein the alkyl portion of the arylalkyl group can be linear, branched, saturated, unsaturated, cyclic, and/or acyclic, and wherein hetero atoms either may or may not be present in either or both of the alkyl portion and the aryl portion of the arylalkyl group, (d) an alkylaryl group, including unsubstituted and substituted alkylaryl groups, wherein the alkyl portion of the alkylaryl group can be linear, branched, saturated, unsaturated, cyclic, and/or acyclic, and wherein hetero atoms either may or may not be present in either or both of the alkyl portion and the aryl portion of the alkylaryl group, (e) a siloxyl group, including linear, branched, cyclic, acyclic, substituted, and unsubstituted, siloxyl groups, and wherein hetero atoms either may or may not be present, (f) silyl groups, including linear, branched, cyclic, acyclic, substituted, and unsubstituted, silyl groups, and wherein hetero atoms either may or may not be present, (g) silane groups, including linear, branched, cyclic, acyclic, substituted, and unsubstituted, silane groups, and wherein hetero atoms either may or may not be present, or (h) a functional group selected from hydroxyl, amine, carboxylic acid, epoxide, fluoroalkyl, halide, imide, acrylate, methacrylate, nitrile, sulfonate, thiol, silanol, oxide, and combinations thereof, and wherein $R_a$, $R_b$, and $R_c$ each, independently of the others, can also be imine groups, ammonium groups, cyano groups, pyridine groups, pyridinium groups, sulfate groups, sulfonate groups, sulfonic acid groups, sulfide groups, sulfoxide groups, phosphine groups, phosphonium groups, phosphate groups, nitrile groups, mercapto groups, nitro groups, nitroso groups, sulfone groups, azide groups, azo groups, cyanato groups, isocyanato groups, thiocyanato groups, isothiocyanato groups, urethane groups, urea groups, or combinations thereof, wherein two or more R groups can be joined together to form a ring.

22. The toner particle according to claim 21 wherein at least one of $R_1$, $R_2$, $R_3$, $R_4$, $R_5$, $R_6$, $R_7$, $R_8$, $R_a$, $R_b$, and $R_c$ is selected from methyl, O—$N(CH_3)_4^+$, ethyl, dibromoethyl, norbornenylethyl, vinyl, trifluoropropyl, chloropropyl, cyanopropyl, mercaptopropyl, aminopropyl, N-methylaminopropyl, propylammonium halide, allyl, polyethyleneoxy, isobutyl, cyclopentyl, cyclohexyl, isooctyl, 1-ethyl-3,4-cyclohexanediol, 3-hydroxy-3-methylbutyldimethylsiloxyl, aminoethylaminopropyl, phenyl, chlorobenzyl, chlorobenzylethyl, aminophenyl, N-phenylaminopropyl, trimethylsiloxyl, norbornenyl, —$OSi(CH_3)_2H$, —H, —OH,

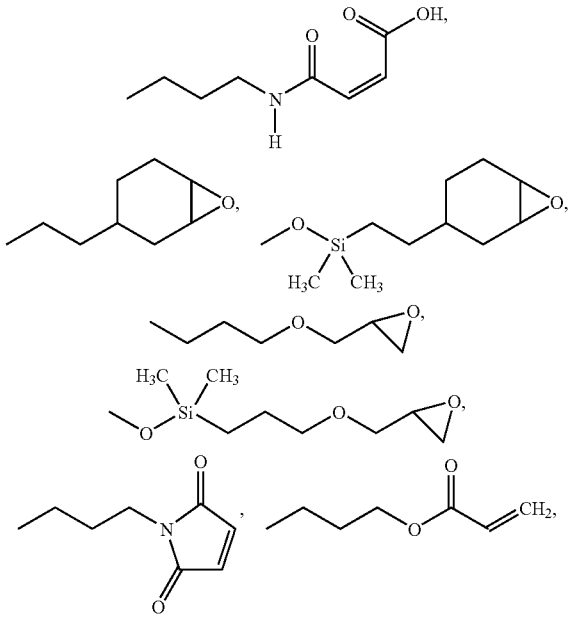

-continued

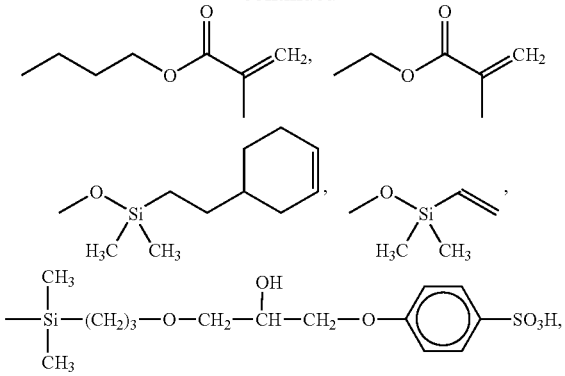

or combinations thereof.

23. A developer composition comprising (a) a toner composition comprising toner particles which comprise a resin, an optional colorant, and a polyhedral oligomeric silsesquioxane compound; and (b) carrier particles.

24. The developer composition according to claim 23 wherein the toner particles are present in the developer in an amount of at least 1 percent by weight of the developer.

25. The developer composition according to claim 23 wherein the toner particles are present in the developer in an amount of no more than 25 percent by weight of the developer.

26. A process for preparing toner particles which comprises (a) contacting at least one resin and polyhedral oligomeric silsesquioxane compound in an emulsion; (b) contacting the emulsion with an optional colorant dispersion, an optional wax, and an optional coagulant to form a mixture; (c) aggregating small particles in the mixture to form a plurality of larger aggregates; and (d) coalescing the larger aggregates to form toner particles.

27. A process for preparing toner particles which comprises (a) contacting at least one resin in an emulsion; (b) contacting the emulsion with an optional colorant dispersion, an optional wax, and an optional coagulant to form a mixture; (c) aggregating small particles in the mixture to form a plurality of larger aggregates; (d) forming a second emulsion by contacting at least one shell resin and polyhedral oligomeric silsesquioxane compound in the emulsion; (e) contacting the larger aggregates with the second emulsion to form a shell over the larger aggregates; and (f) coalescing the larger aggregates to form toner particles.

* * * * *